US005699898A

United States Patent [19]

Bartelmuss et al.

[11] Patent Number: 5,699,898

[45] Date of Patent: Dec. 23, 1997

[54] APPARATUS FOR ADJUSTING ONE OF THE BEARING BLOCKS OF A ROLLER

[76] Inventors: Klaus Bartelmuss; Heinz Bartelmuss, both of Teufenbach Nr. 63, A-8833 Teufenbach, Austria

[21] Appl. No.: 605,760

[22] Filed: Feb. 22, 1996

[30] Foreign Application Priority Data

Mar. 23, 1995 [AT] Austria ..... 520/95

[51] Int. Cl.[6] ..... B65G 39/16

[52] U.S. Cl. ..... 198/806; 198/807

[58] Field of Search ..... 198/806, 807

[56] References Cited

U.S. PATENT DOCUMENTS

| | | | |
|---|---|---|---|
| 2,783,871 | 3/1957 | Sowards | 198/806 |
| 3,312,335 | 4/1967 | Paris et al. | 198/807 |
| 4,664,303 | 5/1987 | Morse et al. | 198/806 X |
| 4,717,267 | 1/1988 | Barthel | 384/247 |
| 4,750,608 | 6/1988 | Harpold | 198/807 |

FOREIGN PATENT DOCUMENTS

| | | | |
|---|---|---|---|
| 5294424 | 11/1993 | Japan | 198/807 |
| 0672525 | 3/1994 | Japan | 198/807 |

*Primary Examiner*—James R. Bidwell

*Attorney, Agent, or Firm*—Herbert L. Lerner; Laurence A. Greenberg; Werner H. Stemer

[57] ABSTRACT

The angular orientation of a roller in a group of rollers supporting a moving belt, such as a screen strip, a conveyor belt or the like, in a paper-making system, is adjusted. One of the bearing blocks is supported on a final control element which is adjustable in the direction of motion of the belt. The control element is moved relative to a support frame with an adjusting device. This causes the angular orientation of the roller supported in the bearing block to vary relative to the longitudinal direction of the belt. The final control element is embodied as a car which is provided with wheels or the like and which can be moved about by the adjusting device relative to the support frame.

15 Claims, 2 Drawing Sheets

APPARATUS FOR ADJUSTING ONE OF THE BEARING BLOCKS OF A ROLLER

BACKGROUND OF THE INVENTION

1. Field of the Invention

The invention relates to an apparatus for adjusting one of the bearing blocks of a roller in a group of rollers supporting and moving an endlessly moved belt, as for instance a screen strip, a conveyor belt, or the like, in a paper production system; the bearing block is disposed on a final control element which is adjustable in the direction of motion of the belt by means of an adjusting device relative to a support frame, as a result of which the angular orientation of the roller supported in the bearing block can be varied relative to the longitudinal direction of the belt.

In systems which are embodied with an endless moving belt, which is guided via a number of rollers disposed side by side, as in the case of a paper-making system which has a screen strip that is guided via a number of successive rollers, it is a requirement that the travel direction of the belt exactly match the direction normal to the axes of the roller group. Conversely, if because of irregularities of the belt or for other reasons the longitudinal direction of the belt deviates from the feed direction of the roller group, causing the direction of motion of the belt to form an acute angle with the feed direction of the roller group, this not only leads to excessive loading stress on the belt, but the belt can also creep laterally out of the roller group area. This may result in functional and operational problems.

2. Description of the Related Art

It has been known heretofore to provide a measuring instrument for monitoring the direction of motion of a belt which is guided via a groups of rollers. The instrument detects excessive deviations in the direction of motion of the belt from the feed direction of the roller group, so that measures can then be taken to correct the direction of motion of the belt. A correction can be made by changing the angular orientation of one or more of the rollers of the roller group slightly.

To be able to vary the alignment of one roller in a group of rollers, it has been known heretofore to embody one of the two bearing blocks as adjustable in the longitudinal direction of the roller group. To that end, a piston-cylinder device is disposed below the bearing block; the cylinder below the bearing block is rigidly secured in the undercarriage of the system, and the bearing block is also supported by the piston, which is adjustable inside the cylinder in the feed direction of the roller group. As a result, by adjusting the piston, the angular position of the roller supported by this bearing block can be adjusted relative to the feed direction of the roller group, and as a result the direction of motion of the belt guided via this roller can be varied.

That prior art apparatus is disadvantageous, however, because the forces absorbed by the bearing block are transmitted via the piston to the cylinder, thus dictating a heavy load on the seals disposed between the piston and the cylinder. Another disadvantage of the prior art apparatus is that the piston-cylinder device is located below the associated bearing block. It is poorly accessible for maintenance or repair.

SUMMARY OF THE INVENTION

It is accordingly an object of the invention to provide a apparatus for adjusting one of the bearing blocks of a roller, which overcomes the above-mentioned disadvantages of the heretofore-known devices and methods of this general type.

With the foregoing and other objects in view there is provided, in accordance with the invention, an apparatus for adjusting a bearing block of a rotating roller supporting a belt traveling in a given direction of motion, comprising:

a final control element supporting a bearing block of a roller, the final control element being a carriage supported in a support frame and being movable relative to the support frame in the given direction of motion of the belt, for adjusting an angular orientation of the roller relative to the belt; and an adjusting device for moving the carriage relative to the support frame.

In accordance with an additional feature of the invention, the carriage has wheels on which it is drivable. Also, the carriage may be provided with guide wheels for defining a direction of motion thereof.

In accordance with an added feature of the invention, there is included a sliding carriage disposed in and being adjustable relative to the support frame in the direction of motion of the belt, and a second adjusting device (e.g. a spindle drive) for moving the sliding carriage, the carriage being adjustably supported in the sliding carriage in the given direction of motion of the belt.

In accordance with a further feature of the invention, there is included an adjusting cylinder connected to the carriage (e.g. laterally thereof), the adjusting cylinder having a piston and a piston rod releasably connecting the piston to one of the end faces of the plate.

In another preferred embodiment of the invention, the sliding carriage is formed with two flanges, each having one groove formed therein for receiving and guiding support devices (e.g. wheels or the like) for the carriage, and the sliding carriage further having a groove formed therein for receiving and guiding guide wheels disposed underneath the carriage.

The invention may also be defined as an improved apparatus for adjusting a bearing block of a roller in a group of rollers supported in a support frame, wherein the rollers support a moving endless belt (e.g. a screen belt or a conveyor belt) in a paper-production system, wherein the bearing block is supported on a final control element which is adjustable relative to the support frame in a longitudinal direction of motion of the belt by means of an adjusting device, and an adjustment of the final control element causes a defined variation of an angular orientation the roller supported in the bearing block relative to the longitudinal direction of the belt. The improvement which comprises: the final control element being a carriage having support devices attached thereto, and including an adjusting device for moving the carriage relative to the support frame.

In yet other words, the objects of the invention are satisfied in that the final control element is embodied by a carriage which is provided with wheels or the like and which can be moved about by the adjusting device relative to the support frame. Since thus the supporting device for the bearing block is formed by a carriage (or car) which is movable by means of a separate adjusting device, the loads exerted by the bearing block on the supporting device are transmitted directly to the supporting frame. Because of the adjusting device, by comparison, only the rolling resistance of the carriage, which depends on the magnitude of the loads exerted by the bearing block, has to be overcome in order to adjust the carriage.

Preferably, the carriage is also embodied with guide wheels. Moreover, the adjusting device is preferably disposed on one of the ends of the carriage. In a preferred embodiment, a sliding carriage is disposed in the support frame and is adjustable relative to the support frame in the direction of motion of the belt by means of a second adjusting device, and in which sliding carriage the first-mentioned carriage is also adjustable in the direction of motion of the belt. As a result, it is possible to preadjust the carriage.

According to other preferred features of the invention, the carriage is embodied as a plate on whose top the bearing block is secured and on whose side faces the wheels or the like are supported. The guide wheels protrude from the underside of the plate. Moreover, an adjusting cylinder can be disposed on the sliding carriage, its piston being releasably connected to one of the end faces of the plate by means of a piston rod. In particular, the adjusting cylinder is located laterally outside the carriage, or outside the bearing block secured to the carriage. Also, the sliding carriage is preferably embodied with two flanges, which are each provided with one groove in which the wheels or the like are guided, and it is also embodied, underneath the carriage, with a groove into which the guide wheels protrude. The second adjusting device may be an adjusting spindle.

Other features which are considered as characteristic for the invention are set forth in the appended claims. Although the invention is illustrated and described herein as embodied in an apparatus for adjusting one of the bearing blocks of a roller, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
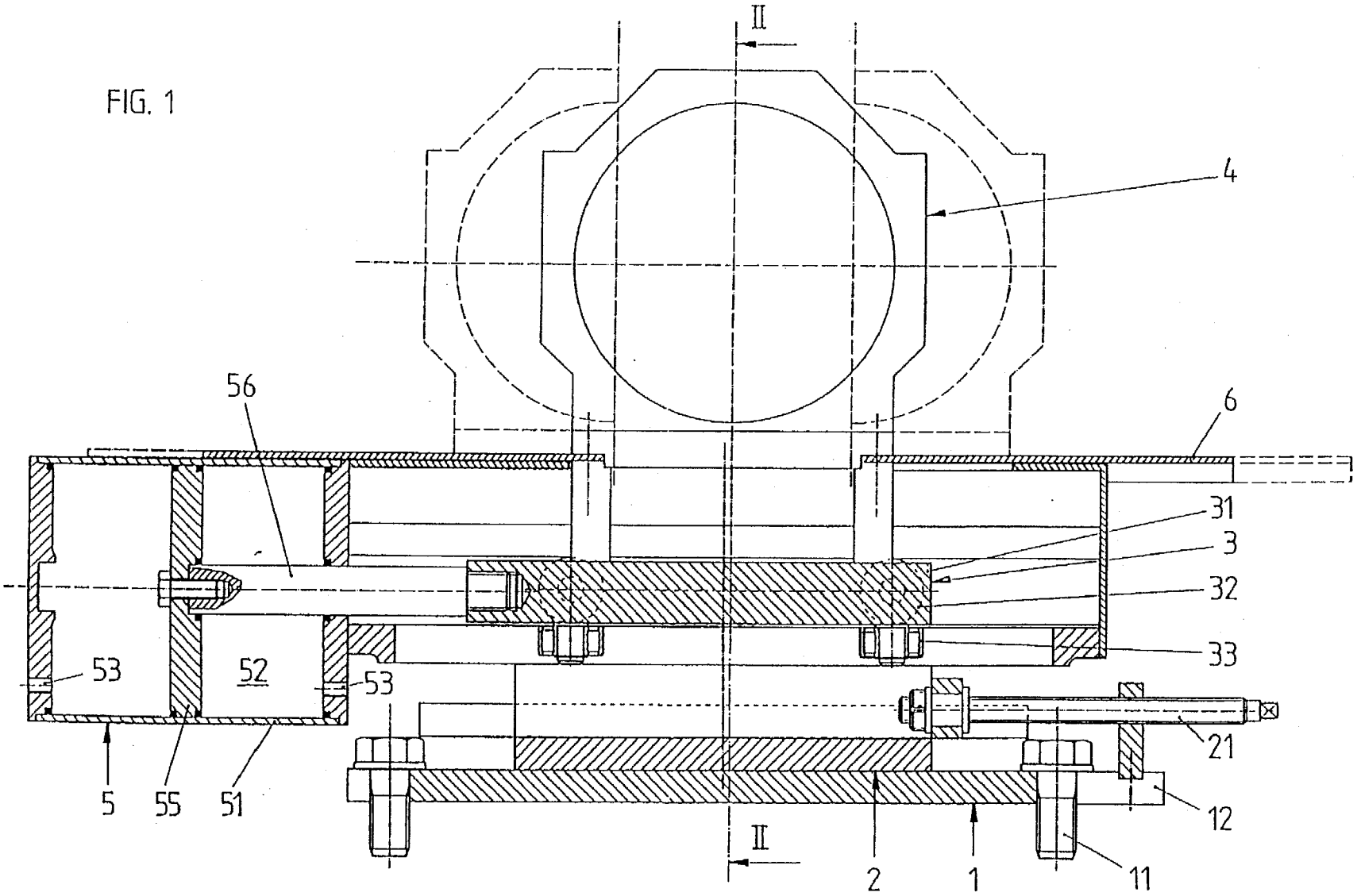
FIG. 1 is an axial sectional view of an apparatus according to the invention.

Referring now to the figures of the drawing in detail and first, particularly, to FIG. 1 thereof, there is seen a support plate 1, which is secured with screw bolts 11 to a frame of a system that has a number of rollers for supporting and moving an endless belt. Since the support plate 1 is formed with slits 12 through which the screw bolts 11 pass, it can be adjusted in the direction of motion of the group of rollers.

Figure 2:
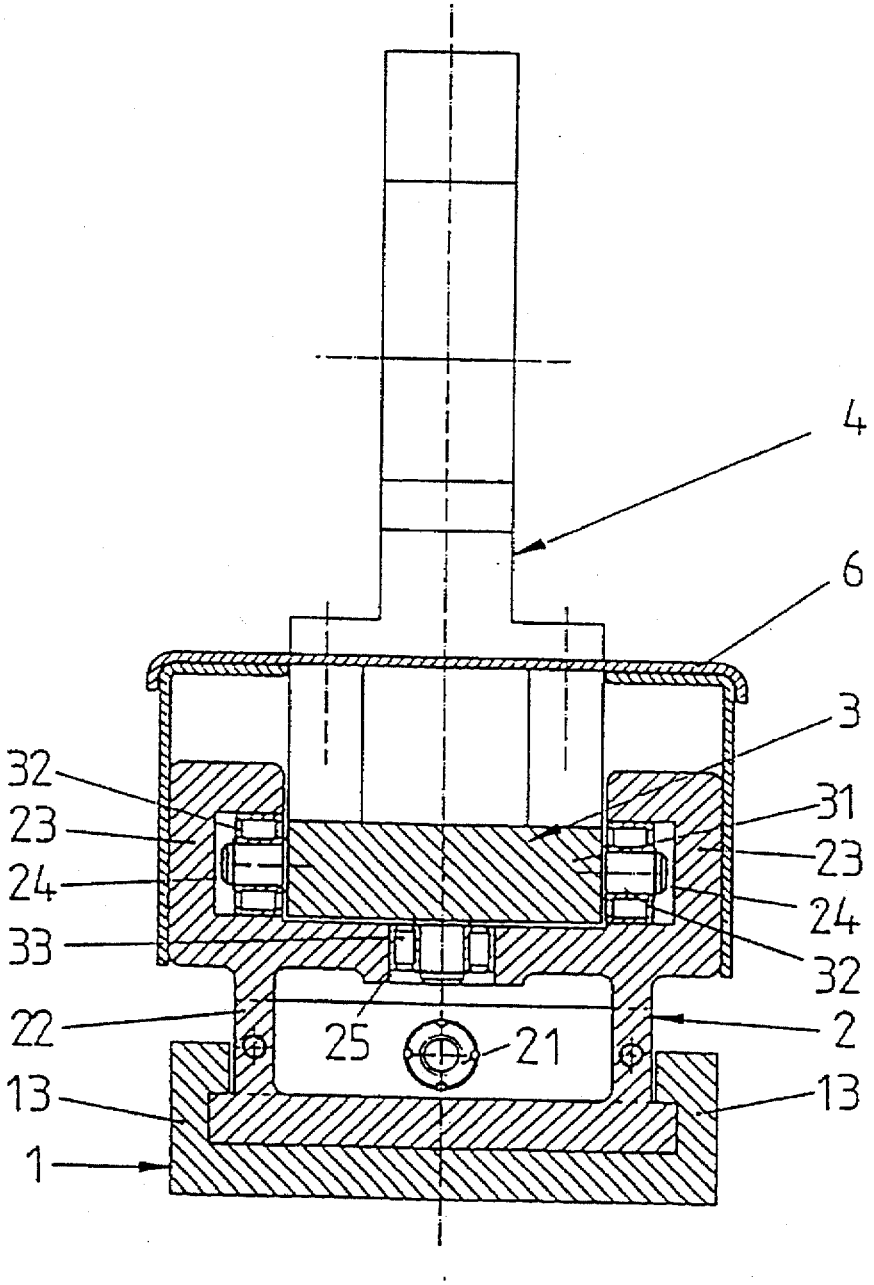
FIG. 2 is a sectional view of the apparatus of FIG. 1 taken along the line II—II of FIG. 1.

With reference to FIG. 2, the support plate 1 is formed with flanges 13 which project upward at the sides and in which a sliding carriage 2 is guided. The sliding carriage 2 (the sled) is adjustable in the direction of motion of the group of rollers, by means of a spindle 21.

The sliding carriage 2 is provided in its lower region with a boxlike profile 22, which is guided between the flanges 13 in the support plate 1. In its upper region, the sliding carriage 2 is embodied with two lateral, upward-projecting flanges 23, which are provided on their insides with grooves 24 that serve to guide a carriage 3 (the car). A bearing block 4 is rigidly secured to the carriage 3. The carriage 3 has a plate 31, which in the region of its two side faces is embodied with wheels 32 that are guided in the grooves 24. The plate also carries a further group of wheels 33 on its underside which are guided in a groove 25 formed in the sliding carriage 2.

Again with reference to FIG. 1, the carriage 3 is adjusted with a piston-cylinder device 5, which is disposed laterally outside the bearing block 4. The device 5 comprises a cylinder 51, whose inner chamber 52 may be selectively acted upon by a pressure medium via openings 53. A piston 55 is shiftably disposed inside the cylinder chamber 52 and is adjustable by feeding the pressure medium to the cylinder 51. The piston 55 is releasably connected to the support plate 31 of the carriage 3 by means of a piston rod 56. The entire apparatus is surrounded by a housing 6.

The mode of operation of this apparatus is described below:

The sliding carriage 2 is adjustable by means of the spindle 21 into a position such that the bearing block 4 assumes a middle position. The roller is now supported in its right angle orientation to the feed direction of the group of rollers. If, to correct the motion of the belt which rests on the respective roller, the angular orientation of the roller relative to the feed direction of the group of rollers must be adjusted, then the inner chamber 52 of the cylinder 51 is acted upon with a pressure medium via one of the openings 53. The piston 55 is thereby adjusted. As a result, the carriage 3 is moved by means of the piston rod 56, and hence the bearing block 4 is likewise adjusted in the direction of motion of the group of rollers and for example assumes one of the positions shown in dashed lines in FIG. 1. As a result, the angular orientation of the roller supported in the bearing block 4 is adjusted relative to the feed direction of the group of rollers. The skew of the belt is adjusted in terms of its direction of motion.

Due to the fact that the loads absorbed by the bearing block 4 are transmitted to the sliding carriage 2 via the wheels 32 of the carriage 3, the drive for the carriage 3 need merely overcome the attendant rolling friction. Since the piston-cylinder device 5 is disposed laterally outside the roller supported by the bearing block 4, it is easily accessible for maintenance purposes. Since moreover the piston-cylinder device 5 is releasably connected to the carriage 3, it can be removed quickly in the event of functional problems and it can be easily replaced with a device that is properly functional. Preferably, in a group of rollers via which a belt is guided, one of the rollers is adjustable.

We claim:

1. An apparatus for adjusting a bearing block of a rotating roller supporting a belt traveling in a given direction of motion, comprising:

a final control element supporting a bearing block of a roller, the final control element being a carriage supported in a support frame and being movable relative to the support frame in the given direction of motion of the belt, for adjusting an angular orientation of the roller relative to the belt;

an adjusting device for moving said carriage relative to the support frame; and a sliding carriage disposed in and being adjustable relative to the support frame in the direction of motion of the belt, and a second adjusting device for moving said sliding carriage, said carriage being adjustably supported in said sliding carriage in the given direction of motion of the belt.

2. The apparatus according to claim 1, wherein said carriage comprises wheels on which it is drivable.

3. The apparatus according to claim 1, which further comprises guide wheels attached to said carriage for defining a direction of motion thereof.

4. The apparatus according to claim 1, wherein said carriage has two face ends, and said adjusting device is disposed on one of said face ends.

5. The apparatus according to claim 1, wherein said second adjusting device is an adjusting spindle.

6. The apparatus according to claim 3, wherein said carriage is a plate having a top and an underside, the bearing block being secured on said top, and including guide wheels supported on and projecting from said underside of said plate.

7. The apparatus according to claim 1, wherein said carriage is a plate with end faces, and further comprising an adjusting cylinder disposed on said carriage, said adjusting cylinder having a piston and a piston rod releasably connecting said piston to one of the end faces of said plate.

8. The apparatus according to claim 7, wherein said adjusting cylinder is located laterally of said carriage.

9. The apparatus according to claim 7, wherein said adjusting cylinder is located laterally of said bearing block secured to said carriage.

10. The apparatus according to claim 1, wherein said sliding carriage is formed with two flanges, each having one groove formed therein for receiving and guiding support devices for said carriage, and said sliding carriage further having a groove formed therein for receiving and guiding guide wheels disposed underneath said carriage.

11. The apparatus according to claim 10, wherein said support devices are wheels laterally formed on said carriage and rolling in said grooves of said flanges.

12. An apparatus for adjusting a bearing block of a rotating roller supporting a belt traveling in a given direction of motion, comprising:

a final control element supporting a bearing block of a roller, the final control element being a carriage supported in a support frame and being movable relative to the support frame in the given direction of motion of the belt, for adjusting an angular orientation of the roller relative to the belt, wherein said carriage is a plate having a top and side faces, the bearing block being secured on said top, and including wheels supported on said side faces on which said carriage is drivable.

13. An improved apparatus for adjusting a bearing block of a roller in a group of rollers supported in a support frame, wherein the rollers support a moving endless belt in a paper-production system, wherein the bearing block is supported on a final control element which is adjustable relative to the support frame in a longitudinal direction of motion of the belt by means of an adjusting device, and an adjustment of the final control element causes a defined variation of an angular orientation of the roller supported in the bearing block relative to the longitudinal direction of the belt, the improvement which comprises:

the final control element being a carriage having wheels attached thereto, and including an adjusting device for moving said carriage relative to the support frame.

14. The apparatus according to claim 13, wherein the belt is a screen strip in a paper mill.

15. The apparatus according to claim 13, wherein the belt is a conveyor belt in a paper mill.

* * * * *